US006983856B1

(12) United States Patent
Burks

(10) Patent No.: US 6,983,856 B1
(45) Date of Patent: Jan. 10, 2006

(54) PORTABLE CRANE

(76) Inventor: Gerald R. Burks, 1184 County Rd. 511, Verbena, AL (US) 36091

( * ) Notice: Subject to any disclaimer, the term of this patent is extended or adjusted under 35 U.S.C. 154(b) by 192 days.

(21) Appl. No.: 10/329,001

(22) Filed: Dec. 26, 2002

(51) Int. Cl.
*B66C 23/18* (2006.01)

(52) U.S. Cl. ..... 212/179; 212/253

(58) Field of Classification Search ..... 212/179, 212/180, 253; 414/543
See application file for complete search history.

(56) References Cited

U.S. PATENT DOCUMENTS

| | | | | | |
|---|---|---|---|---|---|
| 1,540,630 | A | | 6/1925 | Jenks et al. | |
| 2,568,959 | A | * | 9/1951 | Illies | 212/230 |
| 3,077,613 | A | * | 2/1963 | Mayer | 482/139 |
| 3,578,179 | A | | 5/1971 | Fujioka | |
| 3,638,806 | A | | 2/1972 | Hippach | |
| 3,845,869 | A | * | 11/1974 | Sowers et al. | 212/180 |
| 4,560,074 | A | * | 12/1985 | Manning | 212/179 |
| 4,782,962 | A | | 11/1988 | Hackworth et al. | |
| 5,156,517 | A | | 10/1992 | Boissonneault | |
| 5,207,337 | A | | 5/1993 | Massey | |
| 5,348,439 | A | | 9/1994 | Kuhn, Jr. | |
| 6,135,300 | A | * | 10/2000 | Fox | 212/179 |
| 6,425,727 | B1 | * | 7/2002 | Hood | 414/543 |
| 6,467,117 | B1 | * | 10/2002 | Lantz et al. | 14/6 |

* cited by examiner

*Primary Examiner*—Thomas J. Brahan
(74) *Attorney, Agent, or Firm*—George L. Williamson

(57) ABSTRACT

The present invention discloses a portable crane having an elongated boom which attaches at one end to a lower end of a base frame member wherein the upper end of the boom has a stabilizer member attached thereto which stabilizer attached to the upper end of the base frame member. The base frame member is pivotally attached using removable clamps to an upstanding member, for example, a door frame. The boom has a roller pulley attached to its upper end over which a line passes and a means for a motor having a winch mounted thereon attached to the lower end of the boom so that the user can attached one end of the rope to an object to be lifted and run the other end of the rope over the windlass so as to provide a hoist means to lift the object. The crane of the present invention is portable in that it can be moved from one frame member to another frame member so that it can be used at multiple locations internal a building. The crane of the present invention can also be rotated about the vertical axis in approximately an 80 to 90 degree fashion and possibly even up to 180 degrees by having a set of rotatable hinges which attach the base frame member to a pair of removable clamps, which clamps are attached to, e.g., a door frame.

6 Claims, 2 Drawing Sheets

PORTABLE CRANE

BACKGROUND OF THE INVENTION

1. Field of the Invention

The present invention generally relates to cranes and, more particularly, is concerned with a portable crane.

2. Description of the Prior Art

Cranes have been described in the prior art. However, none of the prior art devices disclose the unique features of the present.

In U.S. Pat. No. 5,348,439, dated Sep. 20, 1994, Kuhn, Jr., disclosed a truck which has been adapted to receive the unloading device of the present invention. The unloading device includes a removable rotatable jib frame which is mounted on the partition walls of the truck. An elongated hollow lever arm member is attached to the jib frame for unloading a load. The lever arm member utilizes a mechanical advantage for unloading a load. It incorporates a braking system together with a chain retraction system for ease in safety of operation.

In U.S. Pat. No. 5,156,517, dated Oct. 20, 1992, Boissonneault disclosed a removable hoist system for a doorway of a van which comprises, when in position, a post vertically mounted in the doorway and an arm having one end secured to the post. The arm during operation extends horizontally from the post and a lift mechanism is secured to the other end of the arm, for lifting or lowering objects with respect to the van. A lower plate is secured to the floor of the van where the post is mounted and an aperture centrally positioned in the plate, and an upper plate is secured to a frame portion of the van in the upper part of the doorway, vertically above the lower plate with an aperture centrally positioned in this upper plate. Pins removably received in the aperture of the plates to hold the post in vertical position during operation outwardly extend from the ends of the post. The post is of a length so that when it is in position with its pins in the apertures there is sufficient clearance at the top to permit lifting of the post so that the lower pin is clear of the aperture for removal of the post. The plates have sufficient load bearing strength when secured in position in the van to withstand a predetermined weight of object when lifted or lowered by the lift mechanism.

In U.S. Pat. No. 3,578,179, filed on Jan. 16, 1969, Fujioka disclosed a support portion which includes depending pins at the upper end thereof for fitting within a hole in a corner casting of an associated structure such as a container or the like. A locking bar and a spaced retainer member are carried at the lower part of the support portion and engage a corner port portion of the associated structure for holding the support portion in place. A load-carrying portion is swingably carried by said support portion, the load-carrying portion including a horizontally extending member having means at the outer end for carrying a load.

In U.S. Pat. No. 1,540,630, dated Jun. 2, 1925, Jenks and Nelson disclosed an invention which relates to hoisting devices, and contemplates a structure primarily intended to facilitate the handling of hogs on a farm when butchering. More specifically stated, the invention contemplates the provision of a device adapted to be pivotally mounted upon the door frame of a barn or the like, and constructed to raise and support a hog suspended therefrom.

In U.S. Pat. No. 5,207,337, dated May 4, 1993, Massey disclosed a portable crane which includes a bracket mounted on a shaft extending upwardly from bearings on the vehicle, a boom extending outwardly from the bracket, a spool rotatable in the bracket carrying a cable, which extends outwardly around a pulley, a hook on the outer end of the cable for supporting a load, and a pair of slack adjusters, one of which receives the shaft for rotating the latter and consequently the boom between use and transport positions, the other slack adjuster engaging the spool for rotating the latter to wind the cable thereon.

In U.S. Pat. No. 4,782,962, dated Nov. 8, 1988, Hackworth, et al., disclosed a portable, backpackable crane lift involving a retractable boom, boom cable, winch and winch cable mounted to a wheeled frame with extendable axles all which fold into a compact unit. A shoulder harness apparatus which attaches to the folded unit for carrying converts to a ballast carrying extension of the frame during operation. Such a lift is readily carried up a ladder for use on flat roofs to raise and place air conditioning heat exchangers and the like.

In U.S. Pat. No. 3,638,806, dated Feb. 1, 1972, Hippach disclosed a portable crane with extendable boom of concentrically and eccentrically disposed telescoping tubes in which the first section is a rigid, high-strength square tube and the remaining sections are of progressively reduced diameters with a large diameter cylindrical tube as a second section defining with the first section triangular channels therebetween at the four corners to house sheaves and cable flights of an extension cable system that provides a mechanical advantage greater than two to one for extending the second section and the remaining telescoped tube sections proportionately.

While these cranes may be suitable for the purposes for which they were designed, they would not be as suitable for the purposes of the present invention, as hereinafter described.

SUMMARY OF THE INVENTION

The present invention discloses a portable crane having an elongated beam which attaches at one end to a lower end of a base frame member wherein the upper end of the boom has a stabilizer member attached thereto which stabilizer attached to the upper end of the base frame member. The base frame member is pivotally attached using removable clamps to an upstanding member, for example, a door frame. The boom has a roller pulley attached to its upper end over which a rope passes and a means for a motor having a windlass mounted thereon attached to the lower end of the boom so that the user can attached one end of the rope to an object to be lifted and run the other end of the rope over the windlass so as to provide a pulley means to lift the object. The crane of the present invention is portable in that it can be moved from one frame member to another frame member so that it can be used at multiple locations internal a building. The crane of the present invention can also be rotated about the vertical axis in approximately an 80 to 90 degree fashion and possibly even up to 180 degrees by having a set of rotatable hinges which attach the base frame member to a pair of removable clamps, which clamps are attached to, e.g., a door frame.

An object of the present invention is to provide a crane which can be used to lift heavy objects. A further object of the present invention is to provide a crane having a powered lifting means so that the user can lift objects heavier than what he could himself lift without the assistance of a powered lifting mechanism. A further object of the present invention is to provide a crane which is portable and can be easily moved from one location to another. A further object of the present invention is to provide a crane which is light, simple and easy to manufacture.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
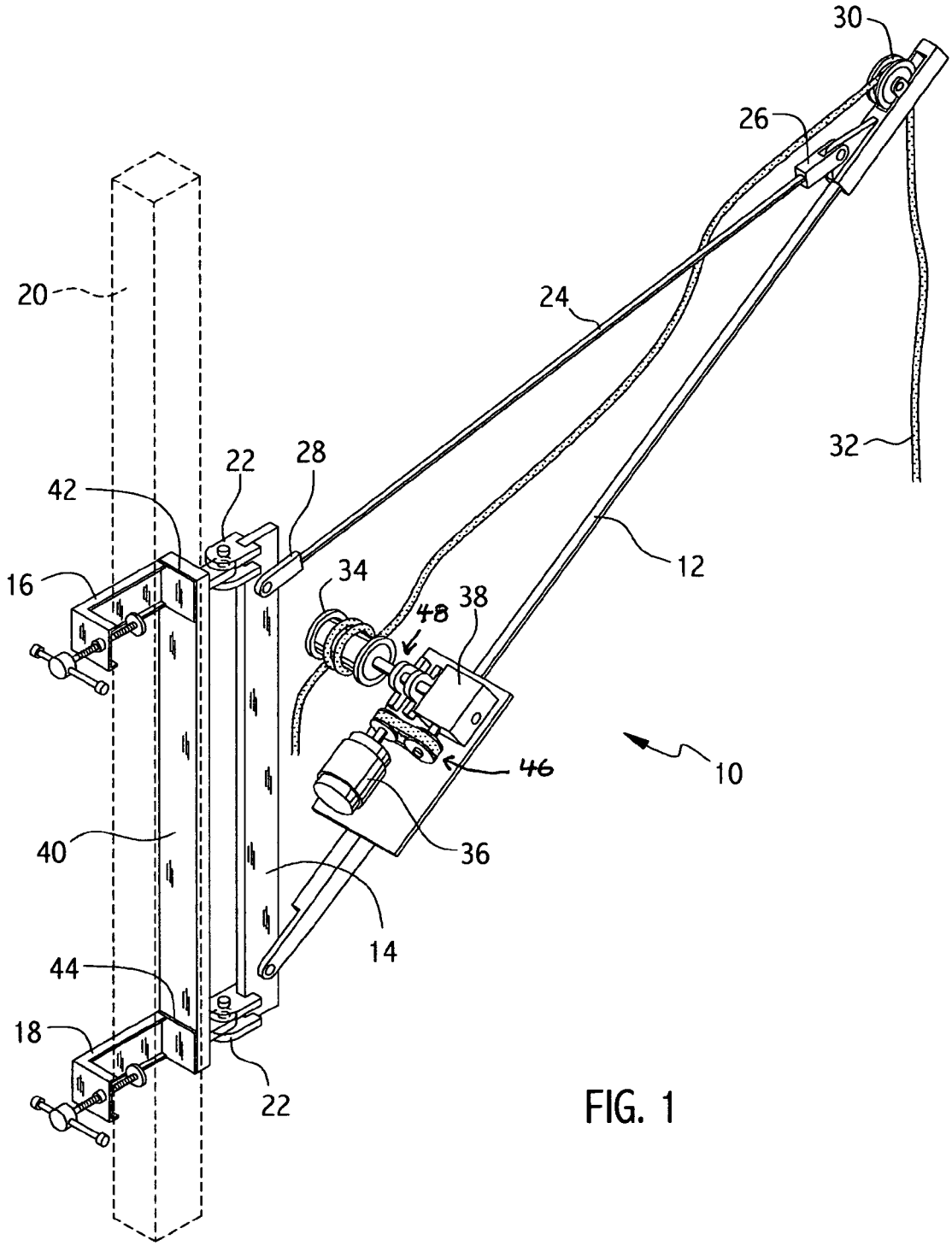
FIG. 1 is a perspective view of the present invention shown in operative connection to a frame member.

With regard to reference numerals used, the following numbering is used throughout the drawings.

10 present invention
12 boom
14 base frame
16 upper clamp
18 lower clamp
20 frame member
22 hinged coupling
24 stabilizer
26 upper stabilizer connection
28 lower stabilizer connection
30 roller
32 rope
34 windlass
36 motor
38 motor connecting means
40 support member
42 connection point
44 connection point
46 belt and pulley
48 bearing and saddle

DESCRIPTION OF THE PREFERRED EMBODIMENT(S)

Figure 2:
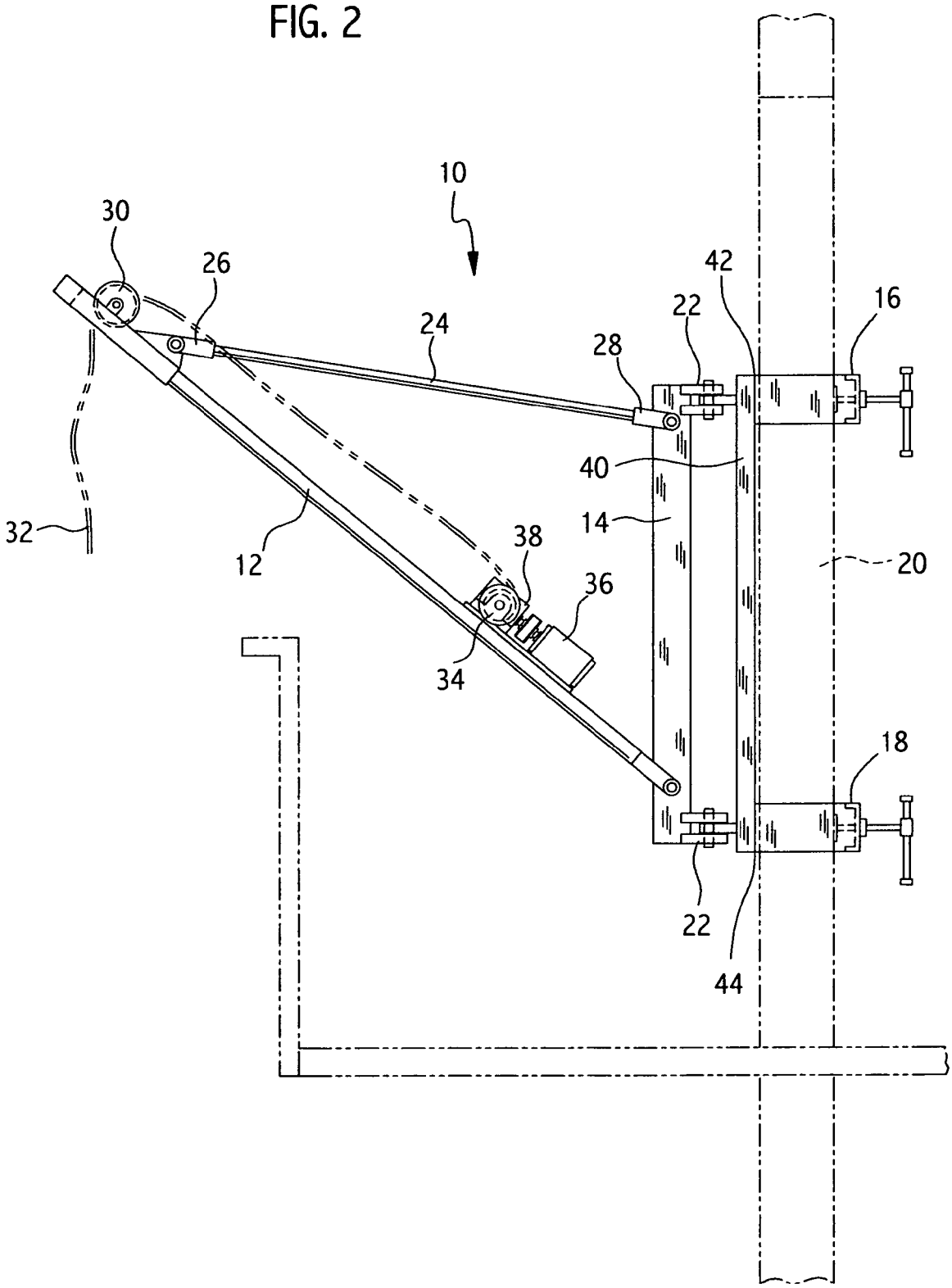
FIG. 2 is an elevation view of the present invention shown in operative connection to a frame member.

In order that the invention may be more fully understood, it will now be described, by way of example, with reference to the accompanying drawings in which FIGS. 1 through 2 illustrate the present invention wherein a portable crane is disclosed.

Turning to FIG. 1, therein is shown a perspective view of the present invention 10. A boom 12 being an elongated arm-like member is shown having a first end attached to a lower portion of an upright standing base frame 14, which frame has an upper clamp 16 and a lower clamp 18 which clamps are attached to a supporting frame member 20 which could be any proximate uprightstanding frame member, for example, a door frame or edge of a door frame of a building. Clamps 16,18 are connected to each other by an upright frame support 40 forming a rigid support frame to which upper clamp 16 is connected at 42 and lower clamp 18 is connected at 44. Clamps 16, 18 may be c-clamps. Base frame 14 is hingedly connected by a hinged coupling 22 at both its upper and lower end so that base frame 14 can rotate in the vertical axis or plane so as to allow the boom 12 to be swung in a substantially horizontal plane toward the left side or toward the right side in a pattern or arc which could be as much as 180 degrees. Boom 12 has a stabilizer member 24 which attaches to the upper end of the boom at 26 and which stabilizer 24 attaches to the upper part of the base frame member 14 at 28. The purpose of stabilizer 24 is to provide a strengthening member to the boom 12 so as to securely attach the boom 12 to the upright base member 14. Boom 12 also has a roller member 30, e.g., a pulley, over which a rope 32 or the like, e.g., a flexible line or cable, can pass which rope has one end which can be connected to an object and a second end which passes over a windlass 34 or the like, e.g., a means for a winch, which is used to provide a means for lifting the object. The boom 12 has a motor means 36 which is used to turn windlass 34. Motor 36 is connected to the windlass through a series or set of gears, or pulleys and belts 46, or bearings and saddles 48, or other mechanical connecting means 38 so that the motor 36 turns the windlass 34 so as to either raise or lower the rope 32. Connecting means 38 may be a transmission or differential using ring and pinion gears.

Turning to FIG. 2, therein is shown an elevation view of the present invention 10 in operative connection. A boom 12 being an elongated arm-like member is shown having a first end attached to a lower portion of an upright standing base frame 14, which frame has an upper clamp 16 and a lower clamp 18 which clamps are attached to a frame member 20 which could be any proximate uprightstanding frame member, for example, a door frame of a building. Clamps 16,18 are connected to each other by an upright frame support 40 forming a rigid support frame to which upper clamp 16 is connected at 42 and lower clamp 18 is connected at 44. Base frame 14 is hingedly connected by hinges 22 at both its upper and lower end so that base frame 14 can rotate about the vertical axis so as to allow the boom 12 to be swung toward the left side or toward the right side in a pattern which could be as much as 180 degrees. Boom 12 has a stabilizer member 24 which attaches to the upper end of the boom at 26 and which stabilizer 24 attaches to the upper part of the base frame member 14 at 28. The purpose of stabilizer 24 is to provide a strengthening member to the boom so as to securely attach the boom 12 to the upright base member 14. Boom 12 also has a roller member 30, e.g., a pulley, over which a rope 32 or the like can pass which rope has one end which can be connected to an object and a second end which passes over a windlass 34 or the like which is used to provide a means for lifting the object. The boom 12 has a motor means 36 which is used to turn windlass 34. Motor 36 is connected to the windlass through a series of gears or pulleys or belts or other mechanical connecting means 38 so that the motor 36 turns the windlass 34.

I claim:

1. A portable crane for attachment to an upright frame member, comprising:

a) a vertically extending support member having upper and lower clamp members on one side thereof for attachment to said frame member;

b) a vertically extending base frame having an upper and lower end;

c) first and second hinged couplings disposed on said base frame connected to an opposite side of said support member allowing said base frame to rotate in a vertical plane around said support member;

d) said upper and lower clamp members being C-clamps horizontally aligned with said first and second hinged couplings, wherein said upper and lower clamp members can be quick connected to said frame member and then quick disconnected from said said frame member, said support member rigidly connecting said upper clamp member to said lower clamp member to provide extra support to said upper and lower clamp members;

e) said first hinged coupling being fixedly connected to said upper end of said support member and said second hinged coupling being fixedly connected to said lower end of said support member;

f) a boom having a first and second end, said first end of said boom being fixedly connected to said lower end of said base frame;

g) stabilizer member having a first and second end, said first end of said stabilizer member fixedly connected to said upper end of said base frame and said second end of said stabilizer member fixedly connected to said second end of said boom to provide stability to the boom;

h) a roller member disposed on said second end of said boom;

i) a flexible line having a first and second end, wherein said flexible line passes over said roller, wherein said second end of said flexible line is for attachment to an article to be lifted by the portable crane;

j) a winch disposed on and between said first and second ends of said boom with said first end of said flexible line can be wound on said winch in order to hoist an article to be lifted by the portable crane; and k) said winch comprising a windlass for receiving said first end of said flexible line, a motor for driving said windlass, and means for connecting said motor to said windlass in order to drive said windlass.

2. The portable crane of claim 1, wherein said flexible line comprises rope.

3. The portable crane of claim 1, wherein said flexible line comprises a cable.

4. The portable crane of claim 1, wherein said boom can swing from side to side in an arc of about 180 degrees.

5. The portable crane of claim 1, wherein said means for connecting said motor to said windlass comprises at least one belt and pulley.

6. The portable crane of claim 1, wherein said means for connecting said motor to said windlass comprises at least one set of gears.

* * * * *